United States Patent [19]

Guenther

[11] 4,019,487

[45] Apr. 26, 1977

[54] ROTARY VALVE SEAL ASSEMBLY

[75] Inventor: William D. Guenther, Hagerstown, Ind.

[73] Assignee: Dana Corporation, Toledo, Ohio

[22] Filed: Nov. 26, 1975

[21] Appl. No.: 635,713

[52] U.S. Cl. ..... 123/190 E; 123/190 A; 123/190 R

[51] Int. Cl.[2] ..... F01L 7/00

[58] Field of Search ..... 123/190 R, 190 E, 190 A, 123/80 R; 277/134, 139, 152, 216

[56] References Cited

UNITED STATES PATENTS

| | | | |
|---|---|---|---|
| 1,102,183 | 6/1914 | Augustin et al. | 123/190 E |
| 1,166,397 | 12/1915 | Woloff | 123/190 A |
| 1,215,993 | 2/1917 | Rimbach | 123/190 A |
| 1,224,557 | 5/1917 | McKelvy | 123/190 A |
| 1,794,061 | 2/1931 | Culver | 123/190 A |
| 1,942,155 | 1/1934 | Stevens | 123/190 E |
| 2,089,582 | 8/1937 | Seifert | 123/190 A |
| 2,459,936 | 1/1949 | Hasler et al. | 123/190 E |
| 2,730,088 | 1/1956 | Hyde | 123/190 A |
| 3,367,666 | 2/1968 | Symons | 277/152 |

*Primary Examiner*—Wendell E. Burns
*Assistant Examiner*—David D. Reynolds
*Attorney, Agent, or Firm*—Richard D. Emch; Robert E. Pollock

[57] ABSTRACT

A seal assembly for a rotary valved internal combustion engine is disclosed. The seal assembly comprises longitudinal side seals for axially sealing an interface between a cylindrical valve housing and a complementary valve rotor body therein. Circumferential ring seals are spaced apart along the valve rotor body for isolating inlet or exhaust ports which extend diametrically through the rotor. The ring seals are provided with a novel means for biasing the seals against the rotor. Spacers are provided for locating and retaining the seals in position within the housing, with bearing rings between the spacers for rotationally supporting the rotor. The assembly also includes means for locating the spacers properly in a head of the engine and for properly orienting the end seals.

16 Claims, 9 Drawing Figures

ROTARY VALVE SEAL ASSEMBLY

BACKGROUND OF THE INVENTION

The present invention relates to a novel seal, rotor and housing assembly for rotary valved internal combustion engines. Many skilled in the engine art have regarded the rotary valved engine—having a driven rotary valve body for a timed admission of a metered charge to an engine cylinder and a timed expulsion of combusted gases from the cylinder—to be theoretically superior to a conventional poppet-valved engine. This is because the rotary valved engine is provided with a valve body or rotor which is rotated in a single direction to effect both inlet and exhaust functions without the cam shafts, push rods, complex springs and reciprocating valving present in conventional internal combustion engines.

A major barrier to the mass production of a rotary valved internal combustion engine has been the difficulty in providing reliable and yet inexpensive seals for the valves in the areas surrounding the inlet and exhaust ports of the valve in communication with the engine combustion chamber.

The lack of reliable seal assemblies has caused most prior art rotary valve engines to fail after only short periods of engine operation, largely because failure of the seals causes high pressure combustion gases to burn out bearing assemblies supporting the valve rotor.

Typical rotary valve seal assemblies have been unsatisfactory for several reasons: first, the seal devices are typically not sufficiently lubricated; second, prior art seals have failed to prevent the travel of pressurized exhaust gases axially along the valve rotor from a cylinder on exhaust stroke, into an adjacent cylinder on intake stroke, causing high pressure gas erosion of the rotor surface, uneven heating of the valve body, and loss of engine efficiency; third, typical prior art rotary valve seals have required milled seal seats within the rotor housing—making the manufacture and assembly of the rotary valve seals on a mass production basis prohibitively expensive.

SUMMARY OF THE INVENTION

The present invention provides a valve rotor, housing and seal assembly which overcomes the disadvantages of prior rotary valve assemblies. The seals of the assembly can, during production, be inserted into a non-milled housing along with a valve rotor, and the seals are extremely reliable and resistant to erosion and failure.

The seal assembly of the invention includes side seals and end seals for providing a gas seal about the periphery of an inlet or exhaust port of the rotor housing, the port being in direct communication with a combustion chamber of the engine. The cylindrical internal surface of the rotor housing supports the complementarily shaped external surface of a valve rotor, against which the seals are in sealing engagement. The side seals extend axially adjacent each side of the housing port, while the end seals, against which the ends of the side seals abut, extend circumferentially around the rotor at the ends of the housing port. Assembled in the cylinder head of the engine, the rotor housing has axial grooves in which the side seals are positioned. The rotor housing acts as a spacer sleeve for locating and retaining in place the circular end seals. The rotor housing also includes an opening or port in communication with the intake or exhaust manifold or the engine. As the valve rotor rotates in the housing, it intermittently places the two housing ports in communication via a through passageway in the rotor defining 180°-opposed rotor ports.

While the rotor itself may be continuous along a bank of combustion cylinders, the housings are preferably separate units for each cylinder. At each end of a housing is assembled an end seal, properly oriented by a locating pin on the housing, then a ring-shaped bearing which rotationally supports the rotor. Oil sealing rings of an elastomeric material may be included between the seal and the bearing for retaining oil at the bearing-rotor interface. In a preferred embodiment some oil is conveyed to the seal-rotor interfaces, however, by helical surface texturing on the rotor. On the opposite side of the bearing is another end seal and another housing, except at the ends of the bank of cylinders.

In the preferred embodiment of the invention the rotor housings are properly oriented in the cylinder head of the engine, and tightly retained therein, by bolts passing through the cylinder head and through a tangential locating groove in the outer surface of each housing.

DESCRIPTION OF THE PREFERRED EMBODIMENTS

Figure 1:
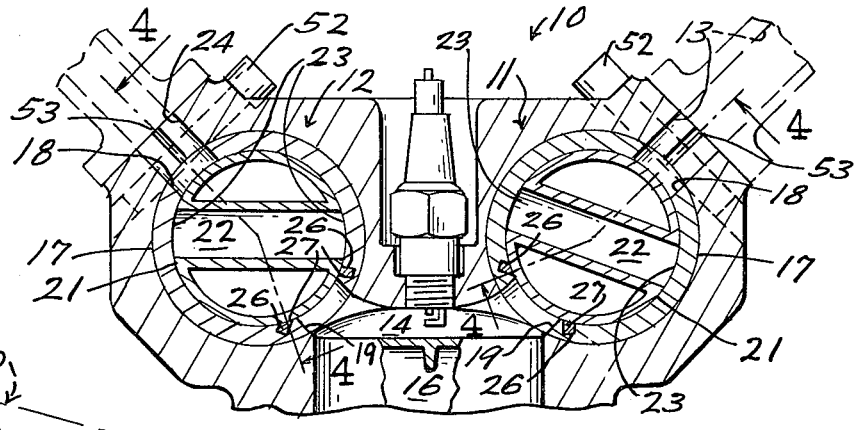
FIG. 1 is a sectional view of a rotary valve type cylinder head of an internal combustion engine including intake and exhaust rotary valve assemblies according to the invention.

Referring to FIG. 1, a rotary valve internal combustion engine head 10 is shown, including intake and exhaust rotary valves generally indicated at 11 and 12, respectively. Separate rotary valves for intake and exhaust are preferred, since the control of gas crossflow between cylinders is made easier with this arrangement. Communicating with the intake valve assembly 11 at the manifold side is a charge passage 13 leading from an intake manifold (not shown) of the engine. At the opposite side of the assembly 11 is a firing cylinder 14 of the engine, with a piston 16 shown therein. A generally cylindrical hollow intake rotor housing 17 is assembled within the head 10 and includes manifold side and combustion side ports 18 and 19, respectively, communicating with the intake manifold and the combustion chamber. Rotatable within the intake valve housing 17 is a generally cylindrical valve rotor 21 having a transverse diametric passageway or conduit 22 therethrough which defines opposed ports 23. As the rotor 21 revolves in the housing 17, driven by the engine's crankshaft at one-fourth the crankshaft speed for a four-stroke cycle engine, it intermittently establishes communication between the manifold and combustion side housing ports 18 and 19, and accordingly between the intake manifold passageway 13 and the combustion cylinder 14. In the typical situation the rotor 21 is elongate, serving simultaneously a bank of combustion cylinders of a multiple cylinder engine. The rotor fits within the housing 17 with a slight clearance, so that the two do not contact, though the clearance is not illustrated in FIG. 1.

On the opposite side of the firing cylinder 14 in the engine head 10 is the exhaust rotary valve assembly 12. The exhaust assembly 12 is constructed similarly to the intake assembly 11, with a rotor housing 17 including manifold side and combustion side ports 18 and 19, and a rotor 21 within the housing 17, having a through conduit 22 defining ports 23. A manifold side passageway 24 connected to the manifold side housing port 18 leads to an exhaust manifold (not shown) rather than an intake manifold. The discussion below applies to both the intake and the exhaust rotary valve assemblies 11 and 12.

By means of the rotary valve assemblies 11 and 12, metered charges of fuel and air introduced to the manifold side intake port 18 are carried through the rotor conduit 22 into the combustion chamber 14, and exhaust gases are expelled from the chamber 14 through the exhaust rotor conduit 22 and the exhaust ports 18, as the respective rotor ports 23 are carried into timed registry with the housing ports 18 and 19.

As shown in FIG. 1, a pair of rotary valve side gas seals 26 are situated on either side of each of the combustion side housing ports 19. The seals 26 are preferably located here rather than adjacent to the manifold side ports 18 so that the port 19 can be sealed off while the valve is closed as discussed below, preventing pressurized gases from escaping to the area around the periphery of the rotor 21. The side seals 26 reside in generally rectangular recess channels or slots 27 in the rotor housings 17. The channels and side seals are preferably inwardly inclined toward the housing port 19 as shown in FIG. 1, rather than being radially oriented, so that they may be as close as possible to the port 19. Also, the side seals 26 are preferably shaped so that contact is established with the rotor 21 along a line parallel and proximate to the adjacent edges of the port 19, for best sealing. The seal line is thus as close to the port as possible. The side seals 26 are biased into contact with the outer surface of the rotor 21, and in conjunction with circular end seals to be described below, they sealingly isolate the combustion chamber side housing port 19 against gas leakage during periods of high pressure in the combustion chamber 14 during the combustion cycle. During most of such high pressure periods, the intake and exhaust valve rotors 21 are rotated to positions wherein the rotor ports 23 are not exposed to the housing ports 19.

Figure 2:
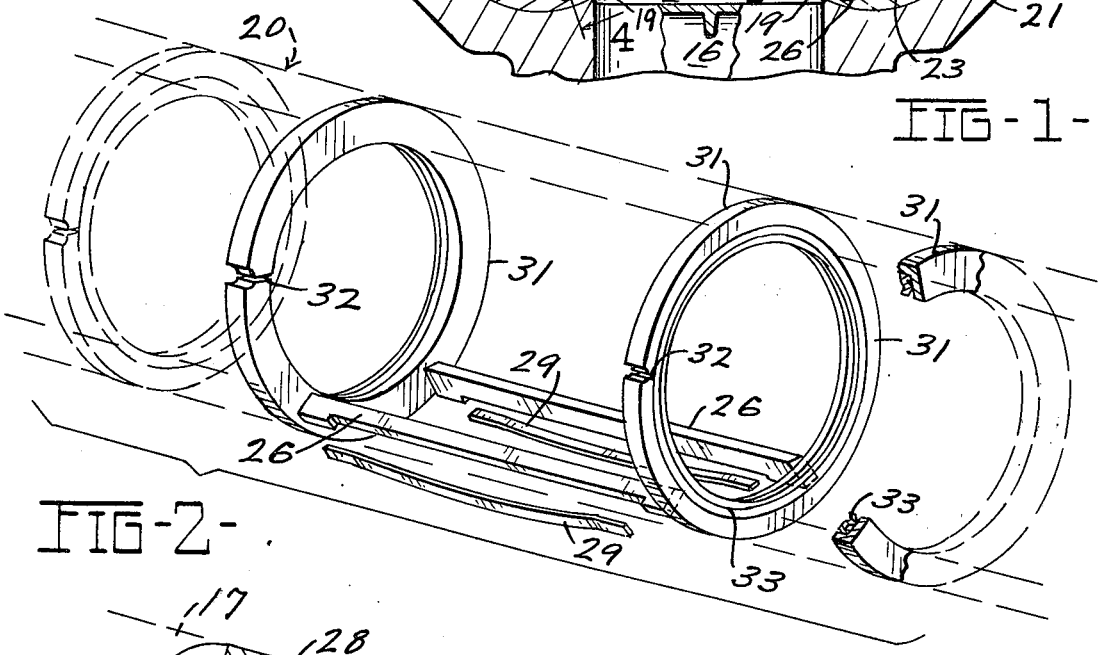
FIG. 2 is an exploded perspective view of a rotary valve seal assembly of the invention with parts broken away and the rotor, valve housings and bearings not shown.
Figure 3:
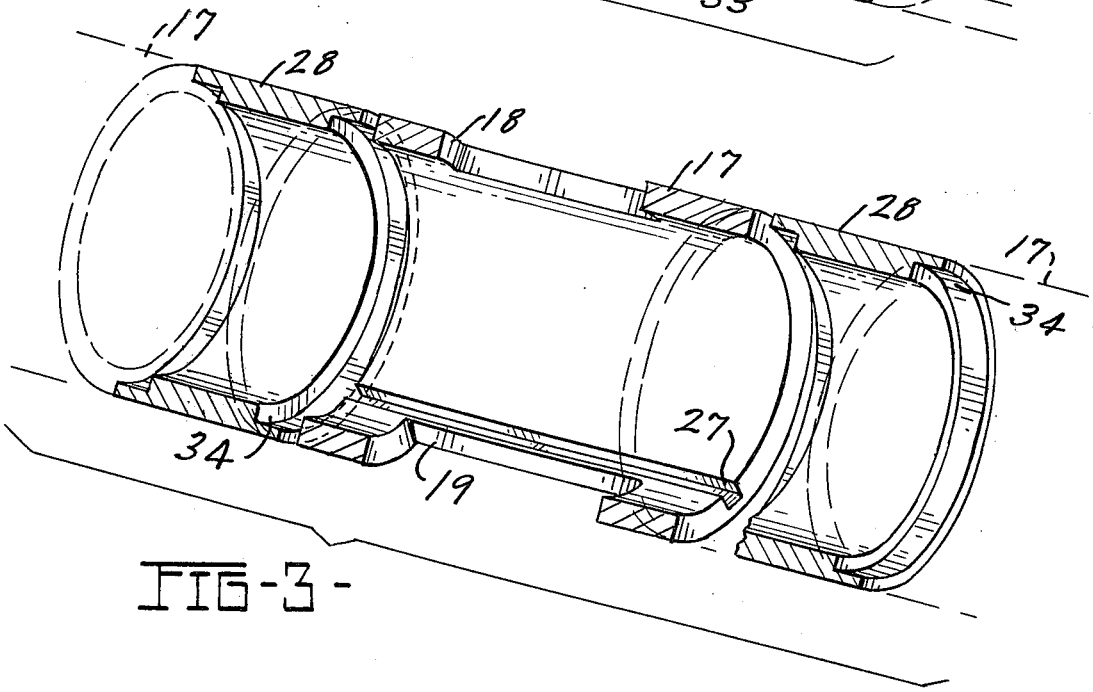
FIG. 3 is an exploded, sectioned perspective view of a rotor housing and rotor bearings of the assembly, corresponding to the seal assembly shown in FIG. 2.

FIGS. 2 and 3 show, in exploded perspective, the valve seal assembly with other parts removed, and the positioning of the rotor housing with respect to the seals, respectively. The sectional view of FIG. 3 also indicates babbitt type bearings 28 which are alternately assembled with the rotor housing 17 and which support the valve rotor 21 for rotation. As the figures indicate, side seals 26, positioned at opposite sides of the combustion side housing port 19, are biased inwardly toward the surface of the valve rotor 21 (not shown in FIGS. 2 and 3) by springs 29 positioned in the housing recess channel 27 below the side seal 26. The bottoms of the side seals 26 are preferably cut out as shown in FIG. 2 to accommodate the springs 29.

At either end of the housing 17 and of the side seals 26, in substantially abutting contact therewith, are ring shaped end gas seals 31 biased for contracting engagement with the exterior surface of the rotor 21. Each end or ring seal 31 has a split 32 oriented to one side of the housing 17, away from the combustion side port 19, for allowing the ring seals 31 to expand and contract. The ring seals 31 are preferably generally L-shaped in cross section, as will be better seen below, to allow resilient oil seal rings 33 to be positioned in the interior angle of the seals. The oil seals 33 will be further described below. For more positive abutting contact between the side seals 26 and the ring seals, the side seals 26 may be of two piece construction (not shown), with an angled transverse division line through a corner portion in each seal to provide for lateral expansion as the seal 26 is biased toward the rotor, such construction, well known in the art, eliminate clearances between the side and end seals.

The rotor bearings 28 are positioned between ring seals 31 and, as indicated in FIG. 3, are arranged generally as extensions of the housing 17. However, the inside diameter of the bearings 28 is slightly smaller than that of the housings 17 to provide a closely journaled bearing surface for the rotor 21. The bearings 28 are generally T-shaped in cross section, defining internal recesses 34 at either end. These recesses 34 receive the ring seals 31 and oil seals 33, so that the bearings 28, when assembled, actually abut against the ends of the housings 17.

At the ends of the bank of firing cylinders of the engine, adjacent the last bearing (not shown) at either end, a sleeve (not shown) similar to a portion of the housing 17 may be provided, without ports, circumjacent the rotor 21 to close off the end internal bearing recesses 34 and hold the associated ring seal 31 in place.

The ring seals 31, positioned circumferentially around the valve rotor 21 adjacent to the ends of the combustion side housing ports 19, are provided for preventing pressurized exhaust gases exiting a combustion chamber from traveling along the surface of the rotor 21 into an adjacent combustion chamber which is on an intake stroke. They thus prevent the axial travel of exhaust gases into or away from each cylinder valve. Similarly, when gases are compressed in a combustion cylinder and neither of the rotary intake and exhaust valves 11 and 12 is open, these seals prevent the axial escape of pressurized gases from that cylinder along the rotor surface. The ring seals 31, as well as the side seals 26, are preferably of cast iron or an alloy which has sufficient softness to wear into sealing relationship with the rotor. Similar in construction to a piston ring, the ring seals are different in that they are predimensioned and stressed so as to be provided with a contracting elasticity when assembled circumferentially around the valve rotor 21. Such stressing can be provided, for example by shot-peening the O.D. of the ring prior to splitting it. This elasticity tends to close the split 32, urging the ring seal into tight sealing contact around the surface of the rotor 21.

Figure 9:
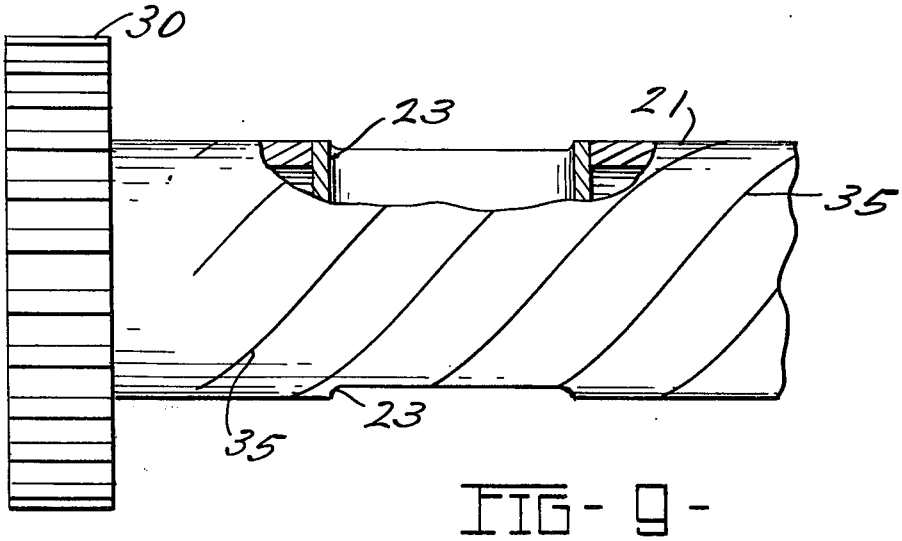
FIG. 9 is a view showing a valve rotor with helical surface texturing for inducing axial oil flow.

A portion of the rotor 21 is shown in FIG. 9. At one end is connected a timing gear 30 for driving the rotor in timed relationship with the crankshaft of the engine by means of a timing chain (not shown). The rotor 21 preferably has a flash chrome surface with helical surface texturing schematically indicated at 35. The texturing 35, which is so shallow in the rotor surface as to be hardly visible to the naked eye, facilitates seal lubrication as discussed below. Such texturing can be provided by advancing the rotor 21 rapidly on final machining of the surface to provide a surface roughness on the order of 12 to 30 RMS (i.e. 0.012 to 0.030 inch root mean square deviation from planar) with grooves at an angle of about 30° to 60° with respect to the axis of the rotor 21.

Although generally rectangular housing and rotor ports 18, 19 and 23 are illustrated herein, for a fixed-timing valve system, the assembly described can be used in connection with an adjustable timing rotary valve system as disclosed in copending and commonly assigned U.S. application Ser. No. 635,714 in which case the ports would be angular with respect to the rotor axis.

Figure 4:
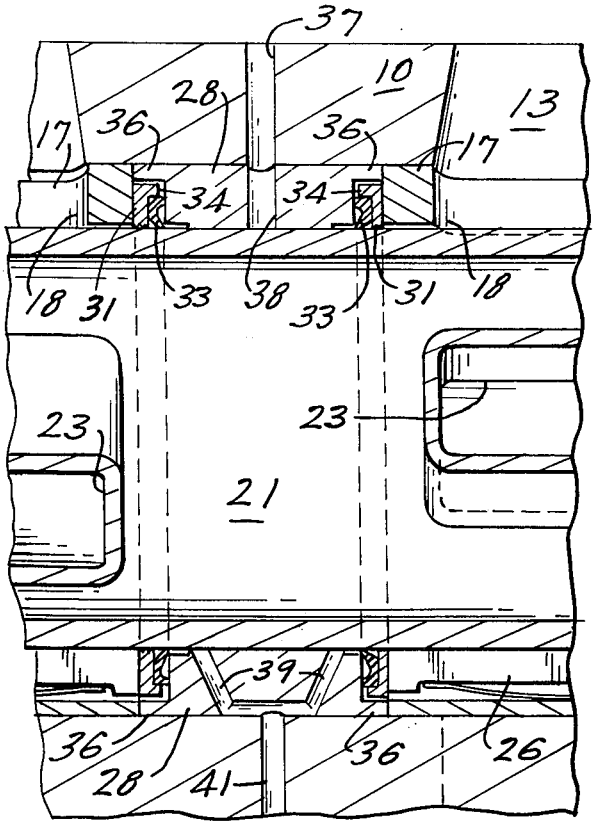
FIG. 4 is a cross-sectional view of the rotor, housing and seal assembly taken along either of the lines 4—4 of FIG. 1.
Figure 6:
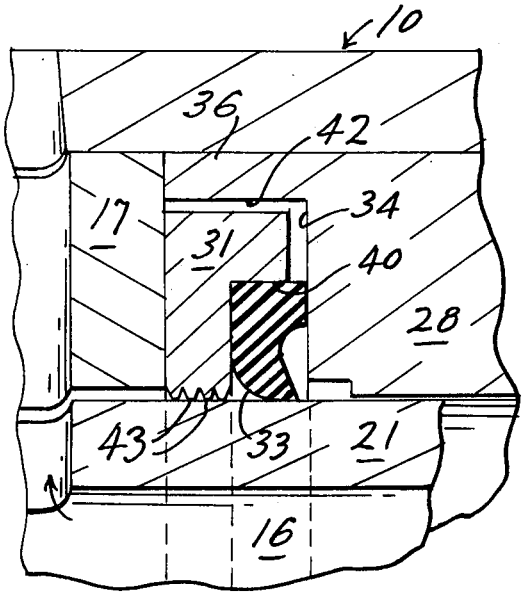
FIG. 6 is an enlarged sectional view showing a portion of the assembly shown in FIG. 4.

FIGS. 4 and 6 show in cross section and in assembled configuration, rotor housings 17, a rotor bearing 28, the rotor 21, ring seals 31, oil seals 33, and side seals 26. Rotor ports 23 and manifold side housing ports 18 are indicated, representing ports of either the intake or exhaust rotary valve assembly 11 or 12. As FIG. 4 indicates, projections 36 of the T-shaped babbitt bearing 28 abut directly against the rotor housings 17, so that the bearing recesses 34 define a predetermined size cavity within which the ring seals 31 and oil seals 33 are positioned. The projections 36 thereby provide a means for spacing apart the bearing 28 and the housing 17 and for spanning the ring seal 31 therebetween. The ring seal 31 is thereby free to move along the axis of the rotor 21 within the cavity. Oil under pressure is admitted to the bearing 28 via bores 37 and 38 in the head 10 and in the bearing itself, respectively, so that a flow is established around the inside surface of the bearing 28. Oil exits the bearing through exit passageways 39 and 41 in the bearing and the head, respectively. The oil seals 33 are positioned on the sides of the ring seals 31 opposite the housing ports as shown, to protect the resilient seals 33 from combustion gases. Consequently, the bulk of the flowing oil is retained between the seals 33 at the bearing-rotor interface. However, a thin film of oil passes under the oil seals 33 to lubricate the interfaces between the rotor and the ring and side gas seals 31 and 26. The movement of this film of oil for lubrication of these sealing interfaces is aided by the helical surface texturing of the rotor 21 as indicated in FIG. 9 and discussed above. The texturing moves oil in one axial direction, so that each seal assembly about a housing port is lubricated from the upstream bearing.

As shown in FIG. 6, the resilient oil sealing ring 33, which is positioned within a recess or stepped area 40 of the seal 31, is of a somewhat arcuate shape in cross section. Upon assembly it is compressed between the gas seal ring 31 and the bearing 28 and, being of a elastomeric material, the arcuate seal 33 is squeezed toward the rotor 21 as it is compressed, thereby exerting some pressure against the rotor surface. The seal 33 is also compressed axially thereby providing an axial force against the bearing 28 and the ring seal 31, urging the ring seal against the face of the housing 17. These forces and pressures are of predetermined magnitude, controlled by the original dimensions of the oil seal 33 and the dimensions of the bearing recess 34 and the ring seal 31. Control of these pressures is important, for instance, because the pressure between the housing 17 and the ring seal 31 is partially depended upon to prevent gas leakage radially outwardly between the surfaces. This prevents such gases from leaking, for example, into a clearance 42 around the periphery of the ring seal 31 to the split 32 (see FIG. 2) of the ring seal, thereby increasing the chances of gas leakage from the assembly. This clearance 42 is provided so that the ring seal 31 can exert its contracting pressure on the rotor 21 without the influence of contact by any peripherally positioned components. Accordingly, pressure between the ring seal 31 and the housing 17 should not be so great as to inhibit the exertion of the ring seal's contracting pressure.

It should be emphasized that control of the tightness between the ring seal and housing and between the oil seal 33 and the rotor surface affects the durability and continued proper function of the seal assembly. Destructive wear and corrosion occur if pressures caused by improper fit between the assembly are not adequately controlled, and the apparatus described herein has been found to provide such control, through the interrelationship of the assembled components and partially through the dimensional control afforded by the bearing flange 36 and recess 34 of the T-shaped bearing 28. The T-shaped bearing eliminates the need for sensitive tightness control of the stack of components including the bearings 28 and housings 17. Such control would be required if fasteners were relied upon for controlling the distance between the bearing and the housing. Previous designs wherein the ring seals were mounted differently proved not sufficiently durable and dependable.

As shown in FIG. 6, the rotor contacting surface of the ring seals 31 preferably comprises a series of narrow rings of contact 43 to establish line-type contact for better sealing and more positive control of axial gas flow. The line-type contact rings 43 are more readily seated against the rotor than would be the case with a single wider interface.

Figure 5:
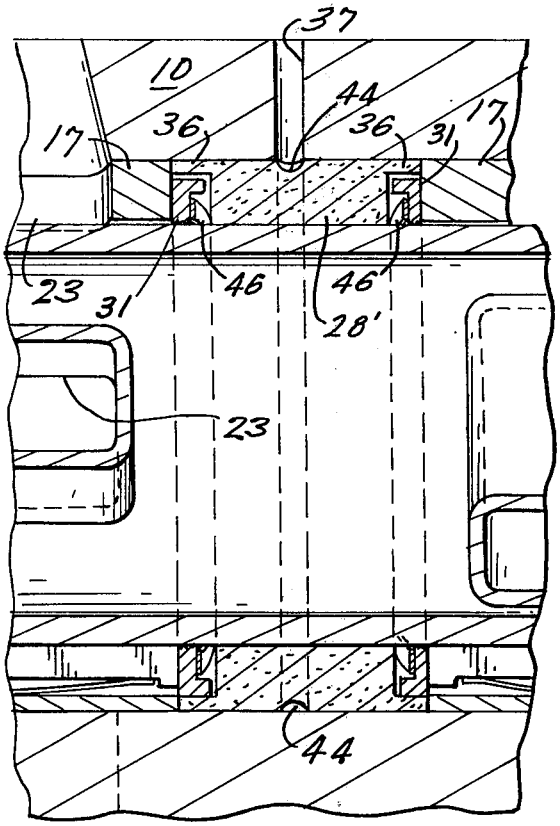
FIG. 5 is a view similar to FIG. 4 but showing an alternative type rotor bearing.
Figure 7:
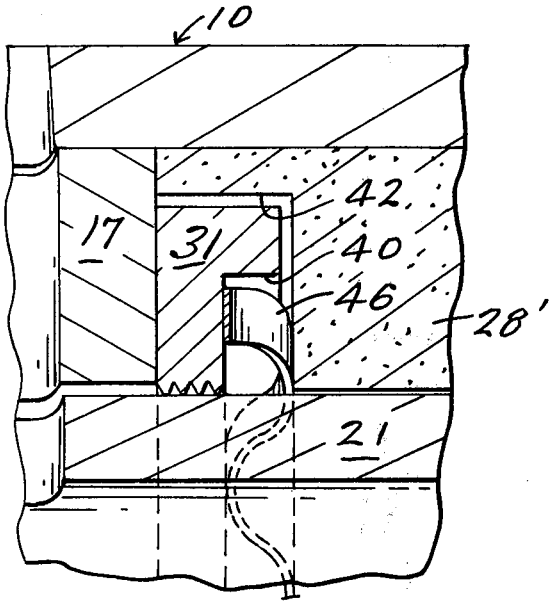
FIG. 7 is an enlarged sectional view similar to FIG. 6 but showing a portion of the assembly of FIG. 5.

FIGS. 5 and 7 show the assembly of FIGS. 4 and 6 but with a different type bearing 28'. The bearing 28' is porous for permitting oil saturation through the bearing and to the inner bearing face. This type bearing may be of sintered metal or other known porous bearing materials. With the porous bearing 28', there is no need for an oil bore through the bearing to connect the bore 37 with the rotor face, nor for exit passageways for effluence of flowing lubricating oil. Instead, oil entering the head bore 37 may be under a slight pressure, or capillarity may be relied upon, so that there is a constant supply of oil to the bearing-rotor interface via the saturation of the porous bearing 28'. A circumferential groove 44 may be provided in the bearing 28' for communicating oil to all areas of the bearing's periphery. In this embodiment, which is somewhat preferred because of its simplicity, the oil seals 33 of FIGS. 2, 4 and 6 can be eliminated because only a film of oil is present between the bearing and the rotor, rather than a pressurized flowing stream. Since it is still desirable to establish a bias force urging the ring seals 31 against the housing 17, a biasing means such as a wave type spring washer 46 is provided at each ring seal 31, in the recess 40 of the bearing to exert a separating force between the seal and the bearing. An elastomeric sealing ring 33 could be provided as in the other embodiment, but it is unnecessary since the bearing 28' is not lubricated with pressurized oil. An axial oil film travel is established by the helical surface texturing of the rotor surface (see FIG. 9), in the same manner as discussed above.

The bearing 28' of FIGS. 5 and 7 may be assembled in any rotational orientation, being completely symmetrical. Similarly, the bearing 28 of FIGS. 4 and 6 may be made rotationally universal by the provision of a circumferential groove (not shown) similar to the groove 44 of the bearing 28'.

Figure 8:
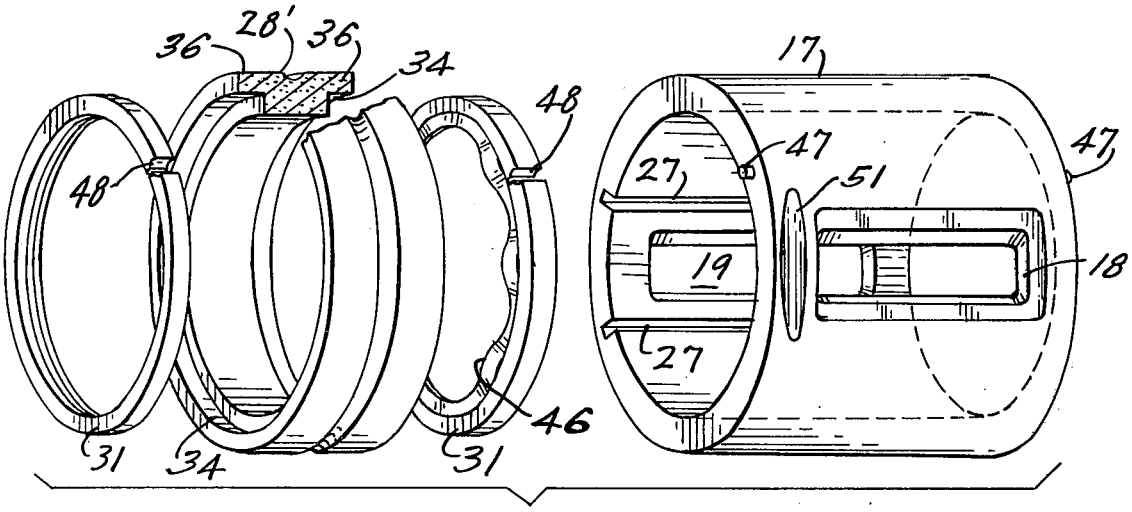
FIG. 8 is an exploded perspective view indicating the manner of assembly of a rotor housing, end seals and a bearing.

The exploded view of FIG. 8, showing the embodiment of FIGS. 5 and 7, indicates the manner of assembly of the rotary valve housings, seals and bearings. The housing 17 includes at both ends a locating means such as pin 47 which registers with arcuate or U-shaped grooves 48 in the adjacent ring seal 31. As indicated, the arcuate groove 48 is conveniently located at the split 32 of the ring seal 31. This assures that, upon assembly, the split 32 is located outside the area between the two side seal recesses 27 adjacent the combustion side housing port 19, so that pressurized gases cannot escape through the split. The pin 47 also prevents rotation of the ring seal 31 in service. As discussed above, the ring seals 31 reside entirely within the bearing recesses 34 in the assembled configuration. The pin 47 does not interfere with the bearing flange 36, being located primarily in the groove 48 and partially in the clearance 42 (see FIG. 7) between the ring seal 31 and the bearing flange 36.

To the left of the left ring seal 31 in FIG. 8, another rotor housing 17 would be positioned, with a locating pin for registry with the arcuate grooves 48 of the ring seal 31 and the bearing 28'. Thus, in a stacked series of housings, ring seals and bearings, all of the components are located in proper rotational alignment with respect to one another upon assembly.

Still referring to FIG. 8, for proper rotational orientation of the housings 17 themselves within the engine's cylinder head 10, an orienting means such as a groove 51 generally tangential to the outer surface of the housing is provided at one end of each housing 17 adjacent to the manifold side port 18 for receiving an assembly bolt 52 seen in FIG. 1. Cooperating means in the head such as head bolts 52, preferably provided for each rotor housing 17, extend through the head 10 at the manifold side of each rotary valve assembly 11 and 12, tangentially to the housings 17 in a mating fit with the grooves 51 in the housing surfaces. The head 10 may include a split 53 (FIG. 1) on each side, transverse to the bolt 52 and continuous through the length of the bank of cylinders, so that when the bolt is tightened the split is drawn toward closure to tightly clamp the head over the housing 17. Such a split 53 can include compressible gasket material (not shown) between cylinders to prevent crossflow of manifold gases, although the avoidance of crossflow is not critical in these areas.

It is to be understood that the above description of the preferred embodiments of my invention is illustrative of my best-known mode of carrying out my invention which is set forth in the following claims.

I claim:

1. A seal assembly for an internal combustion engine having a combustion chamber defined by a cylinder, a piston within the cylinder and a cylinder head and having a cylindrical, driven valve rotor adjacent the combustion chamber for establishing timed, sequential communication between the combustion chamber and a manifold through a diametrically extending passage to the valve rotor, said seal assembly comprising:

a cylindrical hollow rotor housing within the cylinder head and having a combustion side opening in communication with the combustion chamber and a manifold side opening in communication with the manifold, said openings being aligned for registry with the valve rotor passage upon rotation of the rotor;

first seal means within said housing, extending along the axis of the cylindrical valve rotor and located adjacent the axial lengths of each of said combustion side openings, said seals comprising a sealing surface in sealing contact with an outer wall of the valve rotor and having means for biasing said sealing surface against the rotor wall;

second seal means adjacent opposite ends of said housing and extending about the circumference of the valve rotor adjacent opposite ends of each of said combustion side openings and in abutting contact with ends of said first seal means; said second seals comprising an inside sealing surface in sealing contact with the outer wall of the valve rotor and means for inwardly biasing said sealing surface against the rotor wall;

a generally cylindrical hollow rotor bearing adjacent each opposing end of said rotor housing and in rotatively supportive engagement with said rotor;

means for spacing apart said bearing and said housing and for spanning said second seal whereby said second seal is free for axial movement on the rotor; and means for axially biasing each of said second seals against said rotor housing.

2. The seal assembly according to claim 1 wherein said biasing means for said first seal means is a wave spring between said rotor housing and said first seal means.

3. The seal assembly according to claim 1 wherein said inward biasing means comprises a tensional outer surface on said circumferential seal to impart an inward bias to said seal.

4. The seal assembly according to claim 1 wherein said spacing and spanning means comprises a circular outer projecting flange extending axially circumjacent said second circumferential seal, spaced therefrom, and in contact with the end of said housing.

5. The seal assembly according to claim 1 wherein said axially biasing means comprises a wave type spring washer positioned between and in compressed engagement with the ring seal and the end of the bearing.

6. The seal assembly according to claim 1, further including first means for supplying a lubricant to the interfaces between the bearings and the rotor, and second means for supplying lubricant to the seal-rotor interfaces.

7. The seal assembly according to claim 6 wherein said first lubricant supplying means comprises lubricant inflow and outflow conduits in said bearing communicating with the rotor surface, said inflow conduit being connected to a source of lubricant, and wherein said axially biasing means comprises a resilient compressible oil seal positioned between and in compressed engagement with the ring seal and the end of the bearing and in sealing engagement with the rotor surface.

8. The seal assembly according to claim 6 wherein said second means comprises helical surface texturing on the valve rotor, whereby a film of oil is conveyed in one axial direction along the rotor surface.

9. The seal assembly according to claim 1 wherein the rotor is elongate and serves a bank of aligned combustion cylinders, with a diametric conduit for each cylinder, and wherein a rotor housing is positioned at each cylinder, said rotor housings and bearings being serially and alternately positioned along the bank of cylinders with a ring seal between each housing and bearing.

10. The seal assembly according to claim 9 wherein the rotor housings and bearings are of substantially the same outer diameter and are positioned within a elongate bore of the engine's cylinder head.

11. The seal assembly according to claim 10 wherein each rotor housing includes a generally tangential groove in its outside surface, and the cylinder head includes a bore aligned with the groove for receiving a housing locating bolt passing through the bore and the groove.

12. The seal assembly according to claim 1 wherein each end of the rotor housing includes an axially extending pin and wherein the adjacent ring seal includes a complementarily shaped arcuate slot through the width of its outer surface and the bearing includes an opposed complementarily shaped arcuate slot in the inner surface of its projecting flange, both of said arcuate slots being positioned in registry with one another and with the axially extending rotor pin, whereby the ring seal and bearing are positioned in a predetermined orientation and prevented from rotation.

13. The apparatus of claim 12 wherein the arcuate slot in the ring seal is located at the ring seal split, with a portion of the slot being on each side of the split.

14. A rotary valve seal assembly for positioning within an elongate bore in a cylinder head of an internal combustion engine, such bore being adjacent to and in communication with a bank of combustion cylinders and an opposed bank of passageways leading to one of an intake and exhaust manifold of the engine, comprising:

a series of cylindrical, hollow rotor housings, each having opposed ports communicating with a combustion cylinder and the manifold and including axially extending side sealing means on either side of the combustion side port, coextensive with the length of the housing, said housings being sized for assembly within the cylinder head bore;

a cylindrical, ring-shaped rotor bearing between each pair of adjacent housings and at the ends of the end housings, each bearing having an axially extending outer ring flange for abutting contact with the end of the adjacent housing, said ring flange defining an inner recess at the end of the bearing, said bearing being of substantially the same outside diameter as the rotor housing;

a split, contractingly biased ring seal between each bearing and the adjacent rotor housing positioned inside the inner recess of the bearing and spaced from the ring flange; and an elongate, generally cylindrical valve rotor concentrically positioned within the housings, bearings and ring seals, in sealing engagement with the ring seals and said axially extending side sealing means and rotatably supported by the bearings, said valve rotor having, at each rotor housing, a diametric conduit therethrough defining 180° opposed ports positioned to come into intermittent registry with the opposd housing ports as the rotor is revolved.

15. The apparatus of claim 14 wherein each end of each rotor housing includes an axially extending pin and wherein the adjacent ring seal includes a complementarily shaped arcuate slot through the width of its outer surface and the bearing includes an opposed complementarily shaped arcuate slot in the inner surface of its ring flange, both of said arcuate slots being positioned in registry with one another and with the axially extending rotor pin, whereby the ring seal and bearing are positioned in a predetermined orientation and prevented from rotation.

16. The apparatus of claim 14 wherein each rotor housing includes a generally tangential groove in its outer surface, and the cylinder head includes a bolt bore passing generally tangentially to but interfering with the elongate bore, aligned with the groove in assembled configuration, for receiving a housing locating bolt passing through the bore and the groove.

* * * * *

UNITED STATES PATENT OFFICE
CERTIFICATE OF CORRECTION

Patent No. 4019487 Dated April, 26, 1977

Inventor(s) William D. Guenther

It is certified that error appears in the above-identified patent and that said Letters Patent are hereby corrected as shown below:

Colume 5, line 65 "a" should be --an--

Colume 6 line 52 "of sintered metal" should be --of a sintered metal--

Colume 8, line 6, "to" should be --in--

Signed and Sealed this nineteenth Day of July 1977

[SEAL]

*Attest:*

RUTH C. MASON
*Attesting Officer*

C. MARSHALL DANN
*Commissioner of Patents and Trademarks*